US009227102B2

(12) United States Patent
Haddon et al.

(10) Patent No.: US 9,227,102 B2
(45) Date of Patent: Jan. 5, 2016

(54) BIKE TRAINER

(71) Applicants: Timothy F. Haddon, Highland Heights, OH (US); Mary E. Sharoff, Bloomingburg, NY (US); Arthur D. Coberly, Montgomery, NY (US)

(72) Inventors: Timothy F. Haddon, Highland Heights, OH (US); Mary E. Sharoff, Bloomingburg, NY (US); Arthur D. Coberly, Montgomery, NY (US)

( * ) Notice: Subject to any disclaimer, the term of this patent is extended or adjusted under 35 U.S.C. 154(b) by 136 days.

(21) Appl. No.: 14/012,721

(22) Filed: Aug. 28, 2013

(65) Prior Publication Data

US 2014/0066264 A1 Mar. 6, 2014

Related U.S. Application Data

(60) Provisional application No. 61/693,891, filed on Aug. 28, 2012.

(51) Int. Cl.

| | |
|---|---|
| ***A63B 21/00*** | (2006.01) |
| ***A63B 22/06*** | (2006.01) |
| ***A63B 69/16*** | (2006.01) |
| ***A63B 22/02*** | (2006.01) |

(52) U.S. Cl.

CPC ..... *A63B 22/0605* (2013.01); *A63B 22/0235* (2013.01); *A63B 69/16* (2013.01); *A63B 2069/165* (2013.01); *A63B 2069/168* (2013.01)

(58) Field of Classification Search

CPC ..... A63B 21/00
USPC ..... 482/57, 54, 72, 121, 61
See application file for complete search history.

(56) References Cited

U.S. PATENT DOCUMENTS

| | | | | |
|---|---|---|---|---|
| 4,082,265 | A * | 4/1978 | Berkes | 482/61 |
| 4,415,152 | A * | 11/1983 | Smith | 482/61 |
| 5,478,299 | A * | 12/1995 | Harmon et al. | 482/124 |
| 2012/0324682 | A1 * | 12/2012 | Ballentine | 24/535 |

* cited by examiner

*Primary Examiner* — Jerome w Donnelly
(74) *Attorney, Agent, or Firm* — Pearne & Gordon LLP

(57) ABSTRACT

Provided are a bike trainer, and an exercise apparatus with a bike trainer for supporting a bike on a treadmill. A mounting bracket is adapted to be non-invasively installed on a frame of the treadmill utilizing a releasable fastener that is adjustable to secure an installation of the mounting bracket and allow the mounting bracket to be removed from the frame. A plurality of arms are coupled to the mounting bracket and each include a distal end to be positioned at an elevation vertically above an elevation of the belt of the treadmill. A bike coupler is provided adjacent to the distal end of at least one of the arms, and is adapted to cooperate with a portion of the bike to couple the bike to the bike trainer apparatus and maintain the bike over the belt of the treadmill.

21 Claims, 3 Drawing Sheets

BIKE TRAINER

CROSS-REFERENCE TO RELATED APPLICATIONS

This application claims the benefit of U.S. Provisional Application No. 61/693,891, filed Aug. 28, 2012, which is incorporated in its entirety herein by reference.

BACKGROUND OF THE INVENTION

1. Field of the Invention

This application relates generally to a bike trainer and, more specifically, to a bike trainer apparatus to be installed on a treadmill for supporting a bike at a position that allows the bike's wheels to roll over a treadmill belt.

2. Description of Related Art

Conventional bike trainers have traditionally supported the rear wheel of a bike at an elevation above the ground to allow the rear wheel to rotate without advancing the position of the bike forward. A resistance wheel provided to the trainer is urged against the bike's rear wheel to exert a resistive force against rotation of the bike's rear wheel, attempting to slow the bike's rear wheel at all times. This resistance against rotation of the rear wheel is intended to give the rider a sensation similar that experienced by the rider when riding the bike over a roadway or other ground surface.

However, such conventional trainers require the front wheel of the bike to remain stationary. The front wheel rests on the ground near the trainer that is elevating the bike's rear wheel, or on a platform that supports the front wheel at about the same elevation as the rear wheel. Without rotating or otherwise moving laterally, the stationary front wheel provides the user with a monotonous training experience that is much different from the experience of actually riding a bike.

More recently, attempts have been made to mount a bike on a device that allows rotation of the front wheel synchronously with rotation of the rear wheel. For example, the trainer can be provided with a front roller that is linked to the resistance wheel. The linkage between the front roller and the resistance wheel causes the front roller to rotate at the same angular velocity as the resistance wheel. Similarly, other attempts have utilized a front restraint system that connects to the forward portion of a bike or other mounting assembly that maintains a position of the bike on a treadmill-type device. However, all such devices are dedicated exercise devices specific to bike training. As such, they are not suitable for use in activities other than bike training, or include bike mounting hardware that is integrally formed as a single, monolithic unit as part of the treadmill frame.

BRIEF SUMMARY OF THE INVENTION

According to one aspect, the subject application involves a bike trainer, and an exercise apparatus with a bike trainer for supporting a bike at a position that allows wheels provided to the bike to roll over a belt of a treadmill. The bike trainer includes a mounting bracket adapted to be non-invasively installed on a frame of the treadmill utilizing a releasable fastener. The releasable fastener is adjustable from a first state in which the releasable fastener secures an installation of the mounting bracket on the frame to a second state in which the mounting bracket is removable from the frame. A plurality of arms are coupled to the mounting bracket and each include a distal end to be positioned at an elevation vertically above an elevation of the belt of the treadmill. A bike coupler is provided adjacent to the distal end of at least one of the arms, and is adapted to cooperate with a portion of the bike to couple the bike to the bike trainer apparatus and maintain the bike over the belt of the treadmill.

According to another aspect, the subject application involves an exercise apparatus for use in training for biking and running. The exercise apparatus includes a frame with a plurality of frame rails laterally spaced apart from each other. A roller is rotatably supported between the plurality of frame rails adjacent to a first end of the frame along a longitudinal axis. A tensioning member is supported between the plurality of frame rails adjacent to a second send of the frame, opposite the first end of the frame, along the longitudinal axis. A belt extends about the roller and the tensioning member, and an electrical motor is operable to rotate the belt about the roller and the tensioning member. A bike trainer apparatus is removably coupled to the frame for supporting a bike at a position that allows wheels provided to the bike to roll over the belt of the treadmill while the belt is rotating about the roller and the tensioning member. The bike trainer apparatus is separable from the frame without damaging the frame, and includes a mounting bracket non-invasively installed on the frame of the treadmill utilizing a releasable fastener. The releasable fastener is adjustable from a first state in which the releasable fastener secures an installation of the mounting bracket on the frame to a second state in which the mounting bracket is removable from the frame. A plurality of arms are coupled to the mounting bracket and each includes a distal end to be positioned at an elevation vertically above an elevation of the belt of the treadmill. A bike coupler is also provided adjacent to the distal end of at least one of the arms. The bike coupler is adapted to cooperate with a portion of the bike to couple the bike to the bike trainer apparatus and maintain the bike over the belt of the treadmill, allowing the wheels of the bike to roll over the belt while the treadmill is operational.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
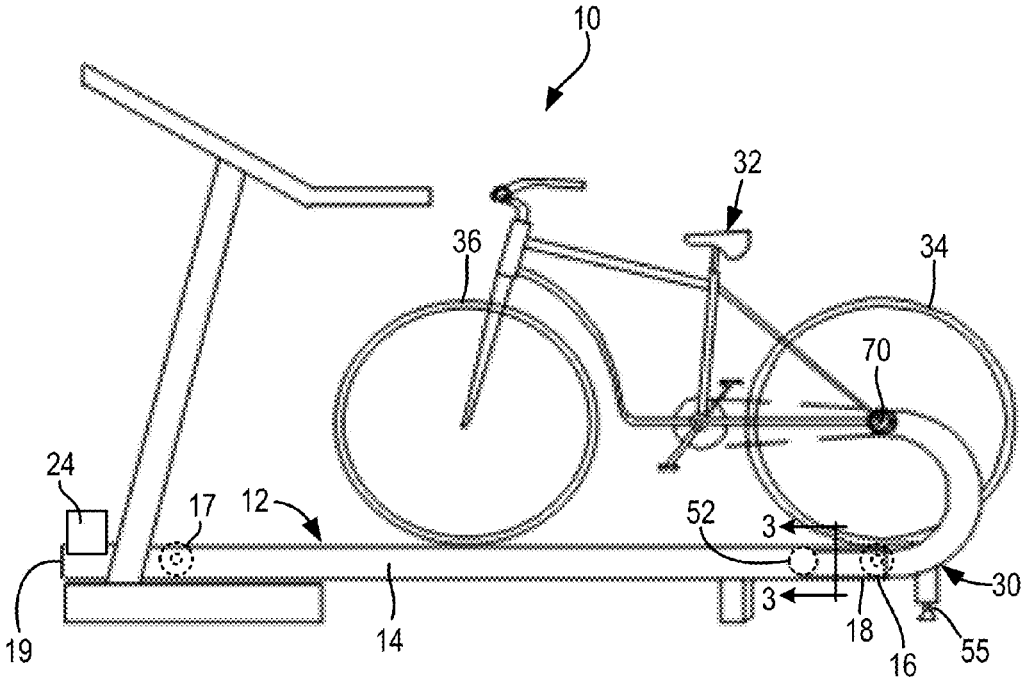
FIG. 1 shows a plan view of a bike supported on a treadmill by an embodiment of a bike trainer non-invasively installed on the treadmill.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Accordingly, there is a need in the art for a bike trainer apparatus that can be retrofit to a treadmill for supporting a bike in a manner that allows the bike wheels to roll over the treadmill's belt to simulate a bike ride over a ground surface. Such a bike trainer apparatus can be non-invasively installed on the treadmill without permanent physical alterations of any portion of the treadmill, allowing the bike trainer apparatus to be removed from the treadmill, thereby returning the treadmill to its configuration prior to installation of the bike trainer apparatus. The bike trainer apparatus can also allow for limited lateral freedom of the front wheel of the bike to traverse the treadmill belt in a transverse direction while traveling over the belt 22.

Figure 2:
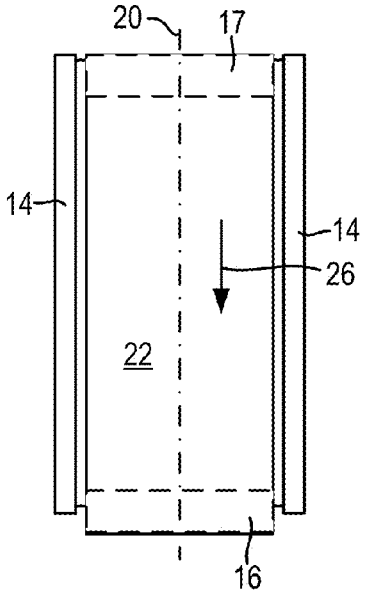
FIG. 2 shows a top view of a treadmill frame supporting a rotatable belt.

FIGS. 1 and 2 show an illustrative embodiment of an exercise apparatus in the form of a treadmill 10, for example, that can be used to train for biking and running. As shown, the treadmill 10 includes a frame 12 comprising a plurality of frame rails 14 laterally spaced apart from each other. Rollers 16, 17, shown as hidden lines in FIG. 1, are rotatably supported between the plurality of frame rails 14 adjacent to aft and forward ends 18, 19, respectively, of the frame 12 along a longitudinal axis 20 of the treadmill 10. At least one of the rollers 16, 17 can serve as a tensioning member to maintain a desired tension on a belt 22 that extends about the rollers 16, 17. An electrical motor 24 is operatively connected by linkage to at least one of the rollers 16, 17, and rotates the belt 22 about the rollers 16, 17. In use, one or more of the rollers 16, 17 is caused to rotate by the motor 24, thereby rotating the belt 22 in the direction of arrow 26. Rotation of the belt 22 in this angular direction simulates the ground surface being traversed by a runner or biker running or moving forward, respectively. The aforementioned portions of the treadmill 10 can be included as part of a treadmill owned by an athlete or gym, for example, for run training. In other words, embodiments can include a conventional treadmill 10 retrofit or otherwise provided with a bike trainer 30 installed in a non-invasive manner, as described in detail below.

The non-invasive manner in which the bike trainer 30 can be installed on the treadmill 10 does not involve any physical modifications of the frame 12, frame rails 14, or other portion of the treadmill 10 from a configuration of the treadmill 10, as purchased, specifically for installation of the bike trainer 30. In other words, the bike trainer 30 can be installed on an existing treadmill 10 that was not built or manufactured with the intent to be utilized for bike training (i.e., involving bike wheels rolling over the moving belt 22). Such a treadmill 10 can optionally be a treadmill 10 specifically adapted for run training, walking, and other activities where a user walks, runs, jogs, or otherwise travels by foot over the moving belt 22. According to other embodiments, the treadmill 10 can include a structural feature anticipating the later installation of a bike trainer 30. For example, a manufacturer of the treadmill 10 may include a pivot pin similar to that described in detail below to which the arms 56 can be coupled. The bike trainer 30 described herein can be coupled to such pins yet still be considered to be non-invasively installed on the treadmill 10. Removing the bike trainer 30 from the treadmill 10 according to such an embodiment does not result in damage to the treadmill 10, and returns the treadmill 10 to its configuration prior to installation of the bike trainer 30. The treadmill 10 can optionally include a motor 24 and/or linkage between the motor 24 and one or more of the rollers 16, 17 to drive the belt 22 at angular velocities faster than a user can achieve on foot, but are commonly encountered on a bike 32. Because the bike trainer 30 includes non-invasive installation structure, the bike trainer 30 can be installed on the treadmill 10 without drilling holes in, welding to, or otherwise physically altering any portion of the treadmill 10 such as the frame rails 14, for example. As a result of this non-invasive installation, the bike trainer 30 can subsequently be removed from a treadmill 10 on which it has been installed to return the treadmill 10 to its physical configuration prior to installation of the bike trainer 30.

The bike trainer 30 can be removably coupled to the frame 12 via the non-invasive installation techniques described herein, or any other technique that does not require a physical alteration of the treadmill 10, for supporting a bike 32 at a position that allows wheels 34, 36 provided to the bike 32 to roll over the belt 22 of the treadmill 10 while the belt 22 is being rotated by the motor 24. The bike 32 can optionally be supported at a location where the rear wheel 34 rolls on the belt 22 as it passes over the roller 16. In other words, the belt 22 can be disposed between a tire provided to the wheel 34 and the roller 16. As mentioned above, the non-invasive installation of the bike trainer 30 allows it to be separable from the frame 12 without damaging or otherwise physically altering the frame 12.

Figure 3:
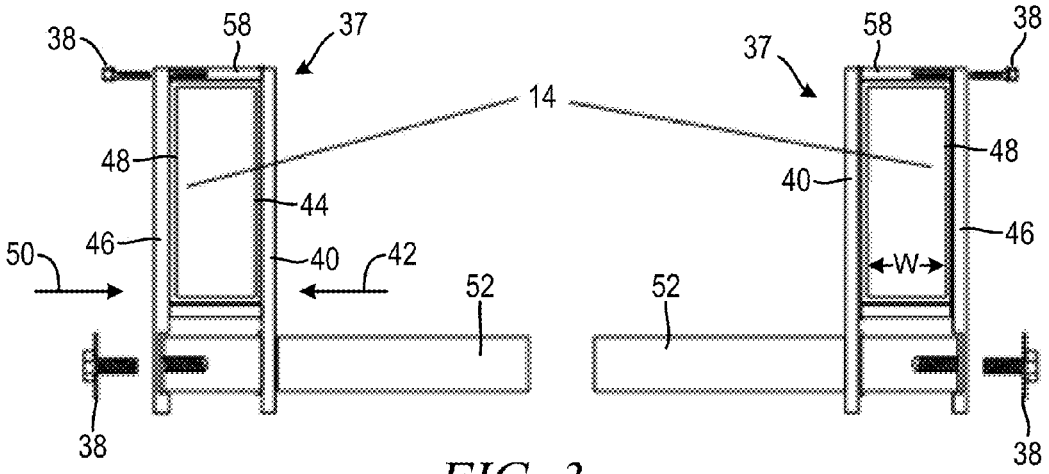
FIG. 3 is a sectional view of a mounting bracket coupled to a frame rail taken along line 3-3 in FIG. 1.

As shown in FIG. 3, an embodiment of the bike trainer 30 includes a mounting bracket 37 that is non-invasively installed on each of the frame rails 14 on opposite sides of the belt 22 utilizing one or more releasable fasteners 38. Although shown as separate entities, alternate embodiments can include a single mounting bracket commonly connected to both frame rails 14 or another part of the frame 12. According to the present embodiment, each mounting bracket 37 includes an interior clamping member 40 which, in FIG. 3, appears as a planar metal plate. The interior clamping members 40 are configured and arranged to exert an outward-directed force (i.e., in the direction of arrow 42 when clamped onto the frame rails 14 and coupled to the exterior clamping members 46 by the fastener 38, outwardly, away from a central region of the treadmill 10 under the belt 22) against an inward-facing surface 44 of the frame rails 14.

Figure 4:
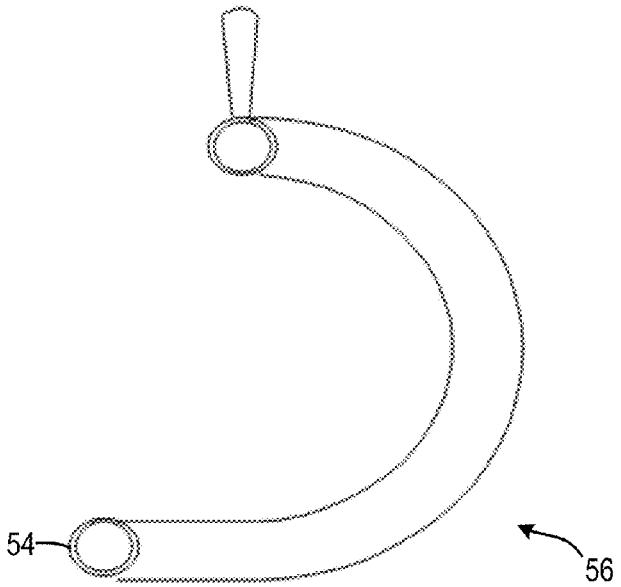
FIG. 4 is a plan view of an arm that is to be pivotally coupled to a frame of a treadmill for supporting a bike on a belt provided to the treadmill.

In addition to interfering with the removal of the mounting brackets 37 from their respective frame rails 14, the interior clamping members 40 each have a pivot pin 52 fixedly secured thereto. For instance, a pivot pin 52 can be welded to each of the interior clamping members 40. Each pivot pin 52 can be a cylindrical-shaped metal rod that extends partially across, but less than the entire distance separating the mounting brackets 37 under the belt 22 of the treadmill 10, as shown in FIG. 3. A sleeve 54, shown in FIG. 4, provided to a proximate end of an arm 56 can be slid over the pivot pin 52, thereby pivotally coupling the arm 56 to the pivot pin 52. The arm 56 can also be adjusted laterally, in a widthwise direction (e.g., in a transverse direction relative to axis 20 in FIG. 2) relative to the belt 22 along the length of the pivot pin 52.

An adjustable foot 55 (FIGS. 1 and 5) can extend between at least one of the arms 56 and a ground surface on which the treadmill 10 rests. The adjustable foot includes a base 57 pivotally coupled to a threaded post 59 that is threadedly engaged with an internally-threaded passage defined by a receiver 61. Rotation of the threaded post 59 relative to the receiver 61 results in cooperation between the threading provided to the post 59 and the internally-threaded passage causing the post 59 to extend further out of, or to retract further into the receiver 61. The extent to which the post 59 extends out of the receiver 16 establishes the desired angular position of the arms 56 about the pivot pins 52 and relative to the mounting brackets 37, thereby establishing a desired elevation of the distal end of the arms 56 above the elevation of the belt 22.

Figure 6:
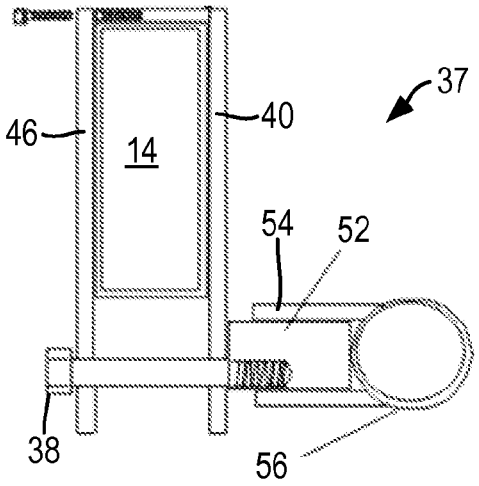
FIG. 6 shows a rear, partially cutaway view of an arm coupled to a mounting bracket with a cam embodiment of a pivot pin.

According to an alternate embodiment, adjustment of the height that a frame coupler 68 is supported by the arms 56 above the belt 22 can be achieved through adjustment of a cam embodiment of the pivot pins 52. An example of such an embodiment is shown in FIG. 6, and includes a fastener 38 extending through the interior clamping member 40 and the exterior clamping member 46. The fastener 38 continues to extend into the pivot pin 52, but at a non-centralized (e.g., offset from a center of a cross sectional view of the pivot pin 52) location. Thus, rotation of the pivot pin 52 about the fastener 38 in FIG. 6 varies the extent to which a portion of the pivot pin 52 is elevated above the longitudinal axis of the fastener 38 and, accordingly, the height above the belt 22 at which the frame coupler 68 is supported.

The pivot pin 52 can extend through the interior clamping members 40, and extend beyond the interior clamping members 40 a length approximately equal to the width W, shown in FIG. 3, of the frame rails 14. As shown in FIG. 3, the exterior clamping members 46 abut against an end of the pivot pin 52 extending beyond the interior clamping members 40. Similarly, an extension 58 protruding from the interior clamping members 40, the exterior clamping members 46, or a combination thereof, bridges the gap separating the interior clamping members 40 from the exterior clamping members 46. The fasteners can extend through the exterior clamping members 46 and into the extension 58 and pivot pin 52, thereby securing the interior clamping members 40 to the exterior clamping members 46 on opposite sides of the frame rails 14. The frame rails 14 are clamped between the interior and exterior clamping members 40, 46, but none of the fasteners 38, or any other aspect of the mounting brackets 37 for that matter, penetrate any portion of the frame 12 or compromise the integrity of any other portions of the treadmill 10. The mounting brackets 37 so installed can be removed from the frame 12 by simply adjusting the fasteners 38 from their installed state to their disassembled state (e.g., turning counterclockwise in the case of threaded fasteners such as bolts, etc. . . . ) to remove them from the interior and/or exterior clamping members 40, 46, and separating the interior and exterior clamping members 40, 46 from each other.

Figure 5:
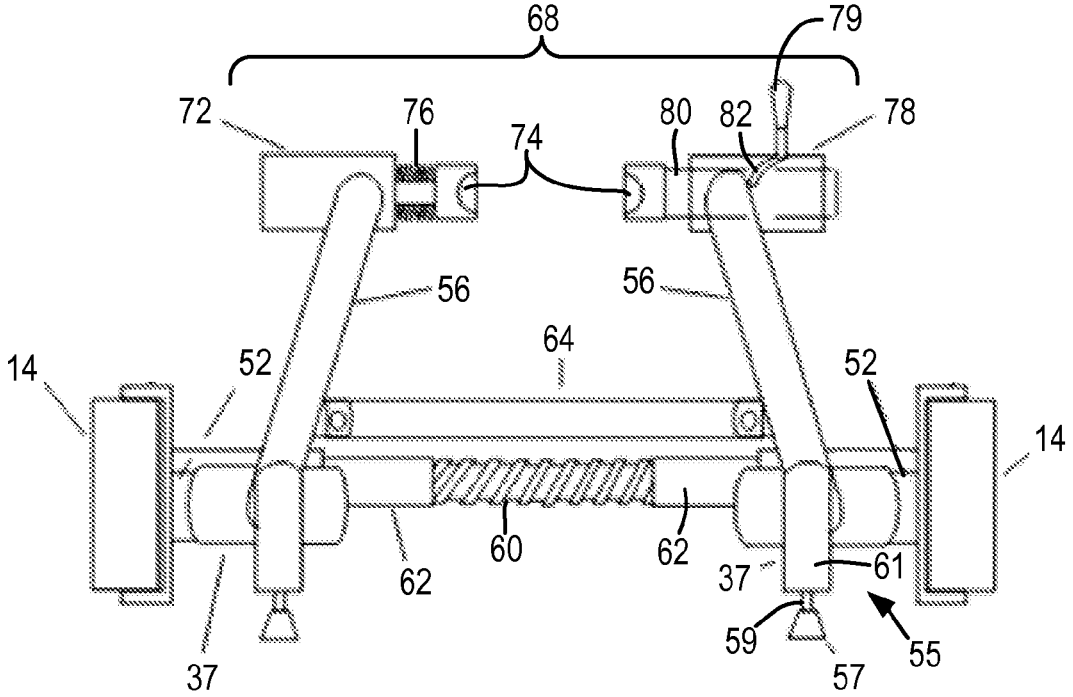
FIG. 5 a rear view of an alternate embodiment of a mounting bracket coupled to a frame rail, the mounting bracket including a pair of arms extending from the mounting bracket and supporting a frame coupler that cooperates with opposite ends of a hub provided to a rear wheel of a bike.

An alternate embodiment of the mounting brackets 37 is shown in FIG. 5. As shown, the mounting bracket 37 includes an interior clamping member 40 abutting against a frame rail 14. Unlike the previous embodiment, the present embodiment of the mounting bracket 37 lacks the exterior clamping member 46. Instead, an acme screw 60 threaded to threadedly cooperate with an acme sleeve 62 coupled to each mounting bracket 37 extends between the mounting brackets 37. Rotation of the acme screw 60 relative to the acme sleeves 62 urges the mounting brackets 37 away from each other, generally toward their respective frame rails 14. This urging force exerted as a result of cooperation between the acme screw and sleeves 60, 62 interferes with removal of the mounting brackets from the frame rails 14. An optional brace 64 can also extend between the arms 56 to minimize their separation when cooperating with the bike 32. For any of the embodiments, the mounting bracket 37 is coupled to the frame rail 14 and extends at least partially, or optionally entirely, about the frame rail 14, but extends along significantly less than an entire length of the frame rail 14, along a longitudinal axis of the frame rail 14.

Each of the embodiments includes an arm 56 extending from each of the mounting brackets 37 that supports a frame coupler 68 that cooperates with opposite ends of a hub 70 (FIG. 1) provided to the rear wheel 34 of the bike 32. Each arm 56, as shown in FIG. 3, includes an arcuate region that bows out far enough to extend out, from under the belt 22 of the treadmill 10, around the roller 16 (FIG. 1), and over the belt 22. The radius of curvature of the arms 56 can optionally be specific to a particular diameter of bike tire 34 the bike trainer 30 is configured to support.

The frame coupler 68 is located adjacent to the distal end of at least one of the arms 56, and is adapted to cooperate with a portion of the bike (e.g., the hub 70) to couple the bike 32 to the bike trainer 30 and maintain the bike 32 over the belt 22 while the treadmill 10 is operational. A first adjustor 72 is operable to vary a distance separating the hub receivers 74 to establish a rough separation of the hub receivers 74 suitable to loosely receive the opposite ends of the hub 70. According to the present embodiment, the first adjustor includes a threaded member 76 that supports one of the hub receivers 74. A second adjustor 78 can be different than the first adjustor 72 (e.g., a cam lock adjustment device), that is operable to vary the distance separating the hub receivers 74 established using the first adjustor 72 and establish a final separation of the hub receivers 74 suitable to secure the hub 70 between the hub separators during operation of the treadmill 10. For instance, the cam lock mechanism includes a lever 79 fixedly attached to a cylindrical member 80 supporting the hub receiver 74. A guide groove 82 defines the range of allowable travel of the lever 79, and accordingly, the allowable rotation of the cylindrical member 80, to urge the hub receiver supported by the member 80 toward the opposing hub receiver 74, thereby securing the hub 70 there between.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A bike trainer apparatus to be coupled to a treadmill for supporting a bike at a position that allows wheels provided to the bike to roll over a belt of the treadmill, the bike trainer apparatus comprising:

a mounting bracket adapted to be non-invasively installed on a frame of the treadmill utilizing a releasable fastener, wherein the releasable fastener is adjustable from a first state in which the releasable fastener secures an installation of the mounting bracket on the frame to a second state in which the mounting bracket is removable from the frame;

a plurality of arms coupled to the mounting bracket and each comprising a distal end to be positioned at an elevation vertically above an elevation of the belt of the treadmill; and a bike coupler provided adjacent to the distal end of at least one of the arms, wherein the bike coupler is adapted to cooperate with a portion of the bike to couple the bike to the bike trainer apparatus and maintain the bike over the belt of the treadmill, allowing the wheels of the bike to roll over the belt while the treadmill is operational, wherein each of the plurality of arms comprises an arcuate region with a radius of curvature specific to position the bike coupler at a wheel-specific elevation above the elevation of the belt specific to a predetermined diameter of bike tire.

2. The bike trainer apparatus of claim 1, wherein the mounting bracket comprises a plurality of interior clamping members, each of said interior clamping members being configured to exert an outward-directed force against an inward-facing surface of frame rails forming portions of the frame and positioned on opposite lateral sides of the belt.

3. The bike trainer apparatus of claim 2, wherein the mounting bracket further comprises a plurality of exterior clamping members, each of said exterior clamping members being configured to exert an inward-directed force against an outward-facing surface of the frame rails positioned on the opposite lateral sides of the belt.

4. The bike trainer apparatus of claim 3 further comprising:

a first adjustable fastener that couples a first one of the interior clamping members to a first one of the exterior clamping members on opposite sides of a first one of the frame rails to exert a compressive force on the first one of the frame rails; and a second adjustable fastener that couples a second one of the interior clamping members to a second one of the exterior clamping members on opposite sides of a second one of the frame rails to exert a compressive force on the second one of the frame rails.

5. The bike trainer apparatus of claim 1 further comprising at least one pivot pin coupled to the mounting bracket, wherein the plurality of arms are pivotally coupled to the at least one pivot pin, and pivotal movement of the plurality of arms about the pivot pin adjusts an elevation of the bike coupler provided to the at least one of the arms above an elevation of the belt.

6. The bike trainer apparatus of claim 1 further comprising an adjustable cam that couples the plurality of arms to the mounting bracket and is operable to adjust a position of the arms relative to the mounting bracket and establish a desired elevation of the distal end of the plurality of arms above the elevation of the belt.

7. The bike trainer apparatus of claim 1 further comprising an adjustable foot that is to extend between at least one of the arms and a surface on which the treadmill is resting, wherein the adjustable foot is adjustable to change position of the arms relative to the mounting bracket and establish a desired elevation of the distal end of the plurality of arms above the elevation of the belt.

8. The bike trainer apparatus of claim 1, wherein the bike coupler comprises opposing hub receivers that receive opposite ends of a hub provided to a rear wheel of the bike.

9. The bike trainer apparatus of claim 8, wherein the bike coupler further comprises:

a first adjustor that is operable to vary a distance separating the hub receivers to establish a rough separation of the hub receivers suitable to loosely receive the opposite ends of the hub; and a second adjustor, that is different than the first adjustor, that is operable to vary the distance separating the hub receivers established using the first adjustor and establish a final separation of the hub receivers suitable to secure the rear wheel of the bike between the hub separators during operation of the treadmill.

10. An exercise apparatus for use in training for biking and running, the exercise apparatus comprising:

a frame comprising a plurality of frame rails laterally spaced apart from each other;

a roller that is rotatably supported between the plurality of frame rails adjacent to a first end of the frame along a longitudinal axis;

a tensioning member supported between the plurality of frame rails adjacent to a second send of the frame, opposite the first end of the frame, along the longitudinal axis;

a belt that extends about the roller and the tensioning member;

an electrical motor that is operable to rotate the belt about the roller and the tensioning member; and a bike trainer apparatus removably coupled to the frame for supporting a bike at a position that allows wheels provided to the bike to roll over the belt of the treadmill while the belt is rotating about the roller and the tensioning member, wherein the bike trainer apparatus is separable from the frame without damaging the frame, the bike trainer apparatus comprising:

a mounting bracket non-invasively installed on the frame of the treadmill utilizing a releasable fastener, wherein the releasable fastener is adjustable from a first state in which the releasable fastener secures an installation of the mounting bracket on the frame to a second state in which the mounting bracket is removable from the frame, a plurality of arms coupled to the mounting bracket and each comprising a distal end to be positioned at an elevation vertically above an elevation of the belt of the treadmill, and a bike coupler provided adjacent to the distal end of at least one of the arms, wherein the bike coupler is adapted to cooperate with a portion of the bike to couple the bike to the bike trainer apparatus and maintain the bike over the belt of the treadmill, allowing the wheels of the bike to roll over the belt while the treadmill is operational, and wherein the bike coupler comprises opposing hub receivers that receive opposite ends of a hub provided to a rear wheel of the bike.

11. The exercise apparatus of claim 10, wherein the mounting bracket comprises a plurality of interior clamping members, each of said interior clamping members exerting an outward-directed force against an inward-facing surface of the frame rails positioned on opposite lateral sides of the belt.

12. The exercise apparatus of claim 11 further comprising an adjustable brace that extends between at least one of the arms and the interior clamping members to maintain a separation of the arms and urge the interior clamping members generally toward their respective frame rails.

13. The exercise apparatus of claim 11, wherein the mounting bracket further comprises a plurality of exterior clamping members, each of said exterior clamping members being exerting an inward-directed force against an outward-facing surface of the frame rails positioned on the opposite lateral sides of the belt.

14. The exercise apparatus of claim 13 further comprising:

a first adjustable fastener that couples a first one of the interior clamping members to a first one of the exterior clamping members on opposite sides of a first one of the frame rails to exert a compressive force on the first one of the frame rails; and a second adjustable fastener that couples a second one of the interior clamping members to a second one of the exterior clamping members on opposite sides of a second one of the frame rail to exert a compressive force on the second one of the frame rails.

15. The exercise apparatus of claim 10, wherein the plurality of arms each comprise an arcuate region with a radius of curvature specific to position the bike coupler at an wheel-specific elevation above the elevation of the belt specific to a predetermined diameter of bike tire.

16. The exercise apparatus of claim 10 further comprising an adjustable cam that couples the plurality of arms to the mounting bracket and is operable to adjust a position of the arms relative to the mounting bracket and establish a desired elevation of the distal end of the plurality of arms above the elevation of the belt.

17. The exercise apparatus of claim 10 further comprising at least one pivot pin coupled to the mounting bracket, wherein the plurality of arms are pivotally coupled to the at least one pivot pin, and pivotal movement of the plurality of arms about the pivot pin adjusts an elevation of the bike coupler provided to the at least one of the arms above an elevation of the belt.

18. The exercise apparatus of claim 10, wherein the bike coupler further comprises:

a first adjustor that is operable to vary a distance separating the hub receivers to establish a rough separation of the hub receivers suitable to loosely receive the opposite ends of the hub; and a second adjustor, that is different than the first adjustor, that is operable to vary the distance separating the hub receivers established using the first adjustor and establish a final separation of the hub receivers suitable to secure the rear wheel of the bike between the hub separators during operation of the treadmill.

19. A bike trainer apparatus to be coupled to a treadmill for supporting a bike at a position that allows wheels provided to the bike to roll over a belt of the treadmill, the bike trainer apparatus comprising:

a mounting bracket adapted to be non-invasively installed on a frame of the treadmill utilizing a releasable fastener, wherein the releasable fastener is adjustable from a first state in which the releasable fastener secures an installation of the mounting bracket on the frame to a second state in which the mounting bracket is removable from the frame;

a plurality of arms coupled to the mounting bracket and each comprising a distal end to be positioned at an elevation vertically above an elevation of the belt of the treadmill;

a bike coupler provided adjacent to the distal end of at least one of the arms, wherein the bike coupler is adapted to cooperate with a portion of the bike to couple the bike to the bike trainer apparatus and maintain the bike over the belt of the treadmill, allowing the wheels of the bike to roll over the belt while the treadmill is operational; and at least one pivot pin coupled to the mounting bracket, wherein the plurality of arms are pivotally coupled to the at least one pivot pin, and pivotal movement of the plurality of arms about the pivot pin adjusts an elevation of the bike coupler provided to the at least one of the arms above an elevation of the belt.

20. A bike trainer apparatus to be coupled to a treadmill for supporting a bike at a position that allows wheels provided to the bike to roll over a belt of the treadmill, the bike trainer apparatus comprising:

a mounting bracket adapted to be non-invasively installed on a frame of the treadmill utilizing a releasable fastener, wherein the releasable fastener is adjustable from a first state in which the releasable fastener secures an installation of the mounting bracket on the frame to a second state in which the mounting bracket is removable from the frame;

a plurality of arms coupled to the mounting bracket and each comprising a distal end to be positioned at an elevation vertically above an elevation of the belt of the treadmill;

a bike coupler provided adjacent to the distal end of at least one of the arms, wherein the bike coupler is adapted to cooperate with a portion of the bike to couple the bike to the bike trainer apparatus and maintain the bike over the belt of the treadmill, allowing the wheels of the bike to roll over the belt while the treadmill is operational; and an adjustable foot that is to extend between at least one of the arms and a surface on which the treadmill is resting, wherein the adjustable foot is adjustable to change position of the arms relative to the mounting bracket and establish a desired elevation of the distal end of the plurality of arms above the elevation of the belt.

21. A bike trainer apparatus to be coupled to a treadmill for supporting a bike at a position that allows wheels provided to the bike to roll over a belt of the treadmill, the bike trainer apparatus comprising:

a mounting bracket adapted to be non-invasively installed on a frame of the treadmill utilizing a releasable fastener, wherein the releasable fastener is adjustable from a first state in which the releasable fastener secures an installation of the mounting bracket on the frame to a second state in which the mounting bracket is removable from the frame;

a plurality of arms coupled to the mounting bracket and each comprising a distal end to be positioned at an elevation vertically above an elevation of the belt of the treadmill; and a bike coupler provided adjacent to the distal end of at least one of the arms, wherein the bike coupler is adapted to cooperate with a portion of the bike to couple the bike to the bike trainer apparatus and maintain the bike over the belt of the treadmill, allowing the wheels of the bike to roll over the belt while the treadmill is operational, and wherein the bike coupler comprises opposing hub receivers that receive opposite ends of a hub provided to a rear wheel of the bike.

* * * * *